US005481861A

United States Patent [19]

Frith

[11] Patent Number: 5,481,861

[45] Date of Patent: Jan. 9, 1996

[54] METHOD OF MAKING A COMPOSITE ELASTIC YARN

[75] Inventor: George A. Frith, Loughborough, United Kingdom

[73] Assignee: Jones Stroud & Co. Ltd., Leicester, England

[21] Appl. No.: 231,876

[22] Filed: Apr. 21, 1994

Related U.S. Application Data

[63] Continuation of Ser. No. 63,121, May 18, 1993, abandoned, which is a continuation of Ser. No. 951,904, Sep. 28, 1992, abandoned, which is a continuation of Ser. No. 529,874, May 29, 1990, abandoned.

[30] Foreign Application Priority Data

May 27, 1989 [GB] United Kingdom ..... 8912305

[51] Int. Cl.[6] ..... D02G 1/04

[52] U.S. Cl. ..... 57/288

[58] Field of Search ..... 257/226, 284, 257/287, 289, 290, 291

[56] References Cited

U.S. PATENT DOCUMENTS

| | | | |
|---|---|---|---|
| 3,078,654 | 2/1963 | Marshall | 57/163 |
| 3,540,204 | 11/1970 | Tanaka et al. | 57/163 |
| 3,691,750 | 9/1972 | Waters | 57/144 |
| 3,771,307 | 11/1973 | Petrille | 57/157 |
| 3,807,162 | 4/1974 | Tsujita et al. | 57/226 X |
| 3,921,382 | 11/1975 | Tsujita et al. | 57/226 X |
| 3,938,314 | 2/1976 | Trammell | 57/157 |
| 3,940,917 | 3/1976 | Strachan | 57/226 X |
| 3,968,638 | 7/1976 | Norton et al. | 57/140 R |
| 3,971,202 | 7/1976 | Windley | 57/140 BY |
| 3,973,386 | 8/1976 | Gorrafa | 57/157 |
| 3,988,883 | 11/1976 | Sze | 57/140 BY |
| 3,991,548 | 11/1976 | Toronyi et al. | 57/226 X |
| 4,051,660 | 10/1977 | Griset, Jr. | 57/140 BY |
| 4,155,214 | 5/1979 | Mirhej | 57/244 |
| 4,222,223 | 9/1980 | Nelson | 57/246 |
| 4,226,079 | 10/1980 | Mountney et al. | 57/288 |
| 4,287,714 | 9/1981 | Takai | 57/336 |
| 4,296,597 | 10/1981 | Tani et al. | 57/205 |
| 4,523,428 | 6/1985 | Negishi et al. | 57/288 |
| 4,648,240 | 3/1987 | Hallsworth et al. | 57/288 |
| 4,674,273 | 6/1987 | Clements et al. | 57/284 X |
| 4,712,366 | 12/1987 | Tsujimoto et al. | 57/245 |
| 4,773,206 | 9/1988 | Kojima et al. | 57/288 |
| 4,870,813 | 10/1989 | Nelson | 57/204 |

FOREIGN PATENT DOCUMENTS

| | | |
|---|---|---|
| 1525044 | 5/1968 | France . |
| 970791 | 9/1964 | United Kingdom . |
| 995536 | 6/1965 | United Kingdom . |
| 1349783 | 4/1974 | United Kingdom . |

OTHER PUBLICATIONS

Journal of the Textile Institute, vol. 69, No. 9, Sep., 1978: The Dynamics of the False–Twist Process, pp. 269–286.

*Primary Examiner*—Joseph J. Hail, III

*Attorney, Agent, or Firm*—Pearne, Gordon, McCoy & Granger

[57] ABSTRACT

A method of making a composite yarn comprising a spandex core yarn and a thermoplastic wrapping yarn in which both yarns are free to extend and contract freely one relative to the other while retaining sufficient cohesion to prevent their separation. The thermoplastics wrapping yarn is polyamide in a flat continuous filament. The wrapping yarn is wrapped in a series of alternating S and Z twists around the spandex core yarn, loops of the wrapping yarn projecting laterally as at positions where a change in the direction of twist occurs.

8 Claims, 5 Drawing Sheets

METHOD OF MAKING A COMPOSITE ELASTIC YARN

Figure 1:
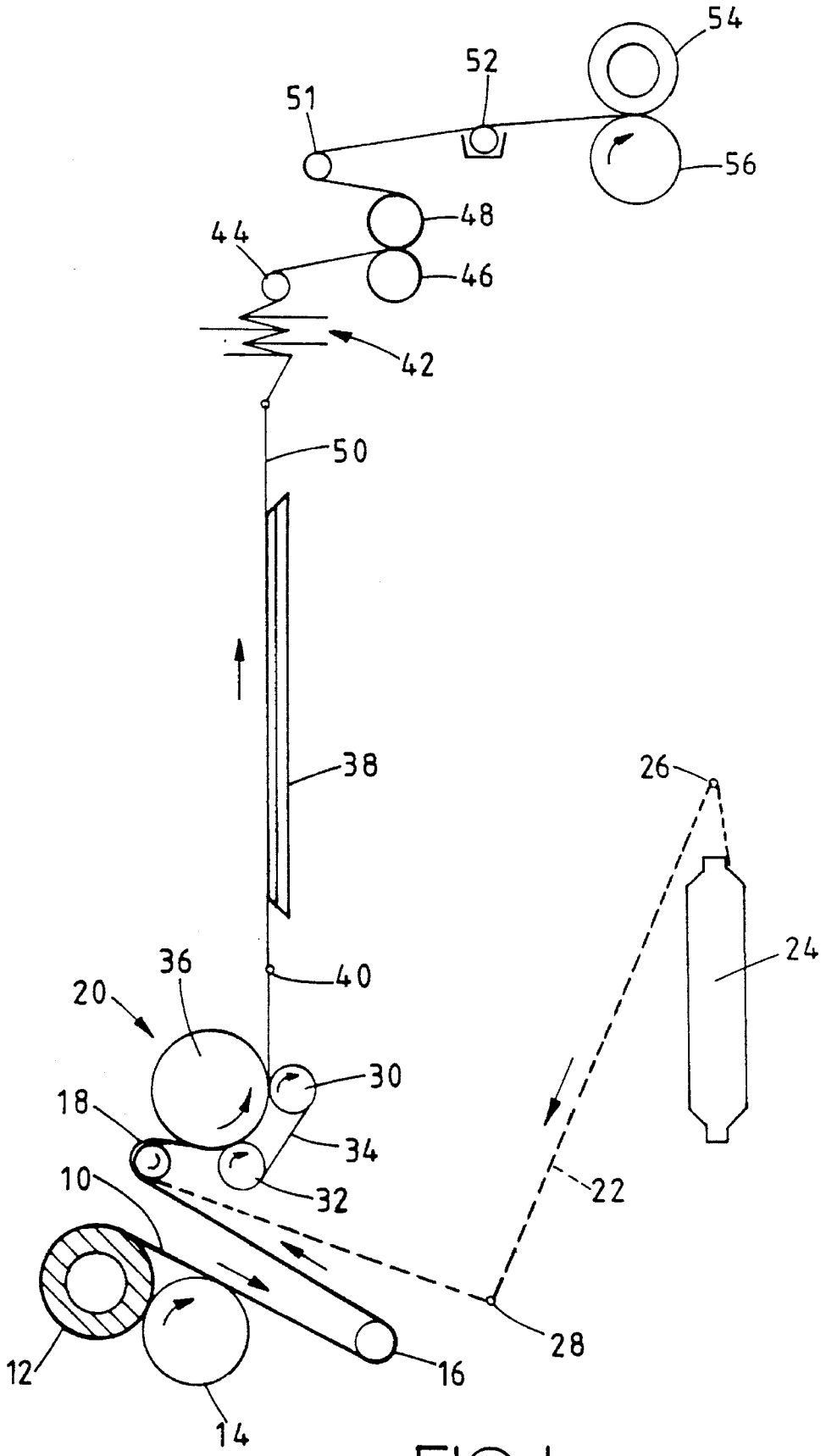

This is a continuation of application Ser. No. 08/063,121, filed May 18, 1993, which is a continuation of application Ser. No. 07/951,904, filed Sep. 28, 1992, which is a continuation of application Ser. No. 07/529,874, filed may 29, 1990, all now abandoned.

The present invention relates to a combined elastic or elastomeric yarn and methods of manufacturing same.

Elastic or elastomeric yarn can be inserted in to certain fabric constructions such as by warp knitting and "laying-in" on circular knitting machines. Bare elastic or elastomeric yarns are difficult if not impossible to knit or weave by themselves. During knitting or weaving the yarn is difficult to control and subjected to variable stretch so that it is difficult to produce a uniformly fabricated textile.

To facilitate fabrication, it is widely known to provide a composite yarn consisting of an elastic or elastomeric core, typically of Lycra (Registered Trade Mark) around which is wrapped a strand or strands of an essentially inelastic yarn, typically of nylon.

One method which has been widely used to produce composite yarn is disclosed in British Pat. No. 970791 and involves the spiral wrapping of the elastomeric core using a bobbin on a hollow spindle. One disadvantage to this method is that the bobbin could be rotated at speeds of between say 10,000 to 25,000 r.p.m. achieving typical but modest production speeds of between 15 and 25 meters/minute.

Another method of producing a composite yarn is disclosed in British Pat. No. 1349783. Fully drawn thermoplastic yarn is wound around an elastic or elastomeric core yarn with the core yarn under tension. The method involves the embedding by a heating, twisting and untwisting process of the thermoplastic filaments in the elastic core yarn without forming loops projecting sideways from the elastic core.

The embedding process necessarily weakens the core yarn by reducing its cross-sectional area at the point of embedding. The weakening causes breakage of the core yarn under the strain of working the yarn, such as by knitting or weaving, thus causing unacceptable fabric faults.

The apparatus disclosed in British Pat. No. 1349783 has been widely used for modifying the filaments of synthetic fibres such as polyamide and polyester. The setting of temporary twist into thermoplastic fibres is known as "texturing".

In both the above-identified British patents, the thermoplastic yarn is fully drawn, i.e. the long chain-like molecules which constitute the yarn filament are arranged orderly lying parallel and close to one another in "oriented" relationship along the fibre axis. This orienting was achieved in a separate, drawing and twisting process.

Undrawn and partially drawn thermoplastic yarns such as polyamide or polyester yarns are now available. In an undrawn yarn the chain-like molecules are arranged randomly. In a partially drawn yarn the molecules have begun to take-up an oriented disposition but further orientation is required to achieve the properties of a textile fibre. This type of yarn is known commercially as P.O.Y. (partially orientated yarn).

An object of the invention is to provide a, composite yarn in which extension of the elastic or elastomeric yarn is continuously matched to that of the thermoplastic yarn to enable uniform stretching and recovery.

In accordance with the first one aspect of the present invention there is provided a method of manufacturing a combined yarn which comprises feeding a pre-stretched spandex yarn to a guide position, feeding a polyamide or polyester yarn separately to the guide position to lie adjacent to the spandex yarn, feeding both yarns to a false twister by way of a heater, heating both yarns at the heater to a temperature sufficient to soften but not melt them, whilst simultaneously subjected the yarns to twist spiral, permitting the heated and mutually generally twisted composite yarn to set without fusing to retain imparted twist, a reverse twist being imparted to the set composite yarn at the exit from the false twister, said reverse twist providing an overall torque to the composite yarn in the same direction as that of the spirally-set twist.

By spandex we refer to a synthetic elastic fiber of a long-chain polymer composed of at least 85% of a segmented polyurethane.

In accordance with a second aspect of the present invention, there is provided a composite yarn comprising a spandex yarn and a thermoplastic yarn arranged in generally spirally twisted configuration with the yarns unfused, sections of the composite yarn having a real twist heat set in one direction with occasional sections having twist heat set in a second direction opposite to that of said first direction providing the composite yarn with an overall torque in said one direction, self-twisting forces being generated in both yarns which reinforces yarn cohesion.

Figure 2:
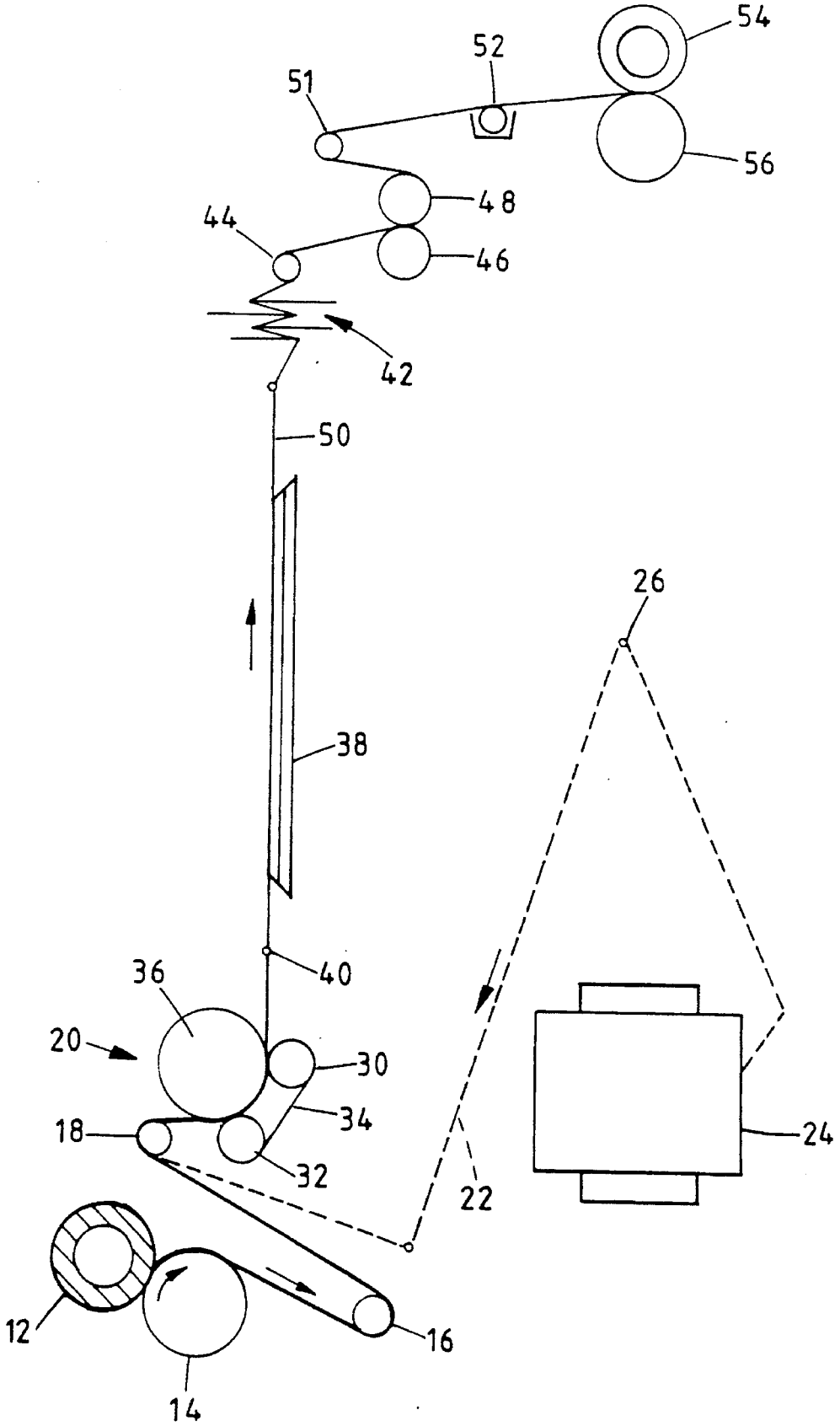
Figure 3:
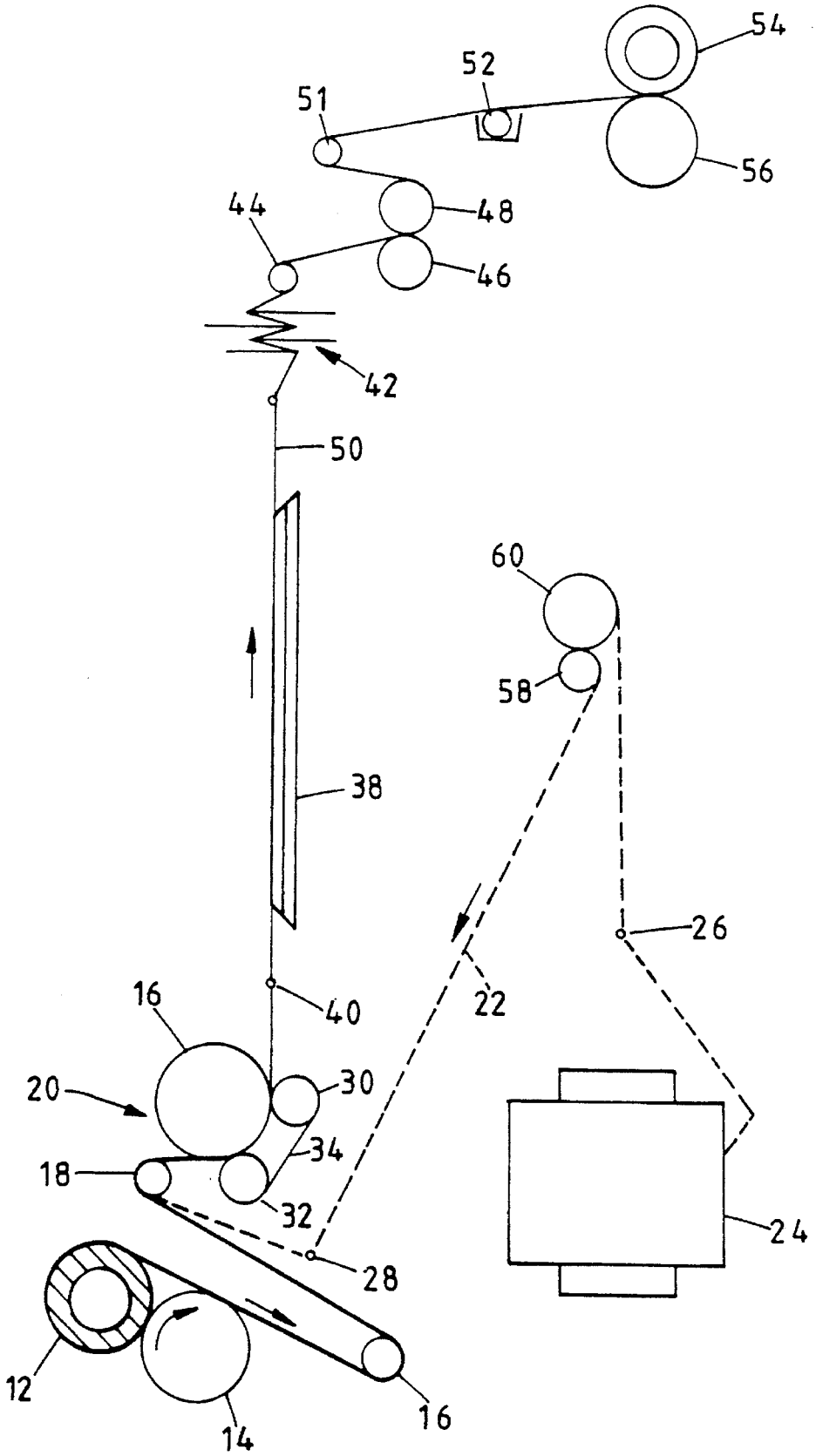
Figure 4:
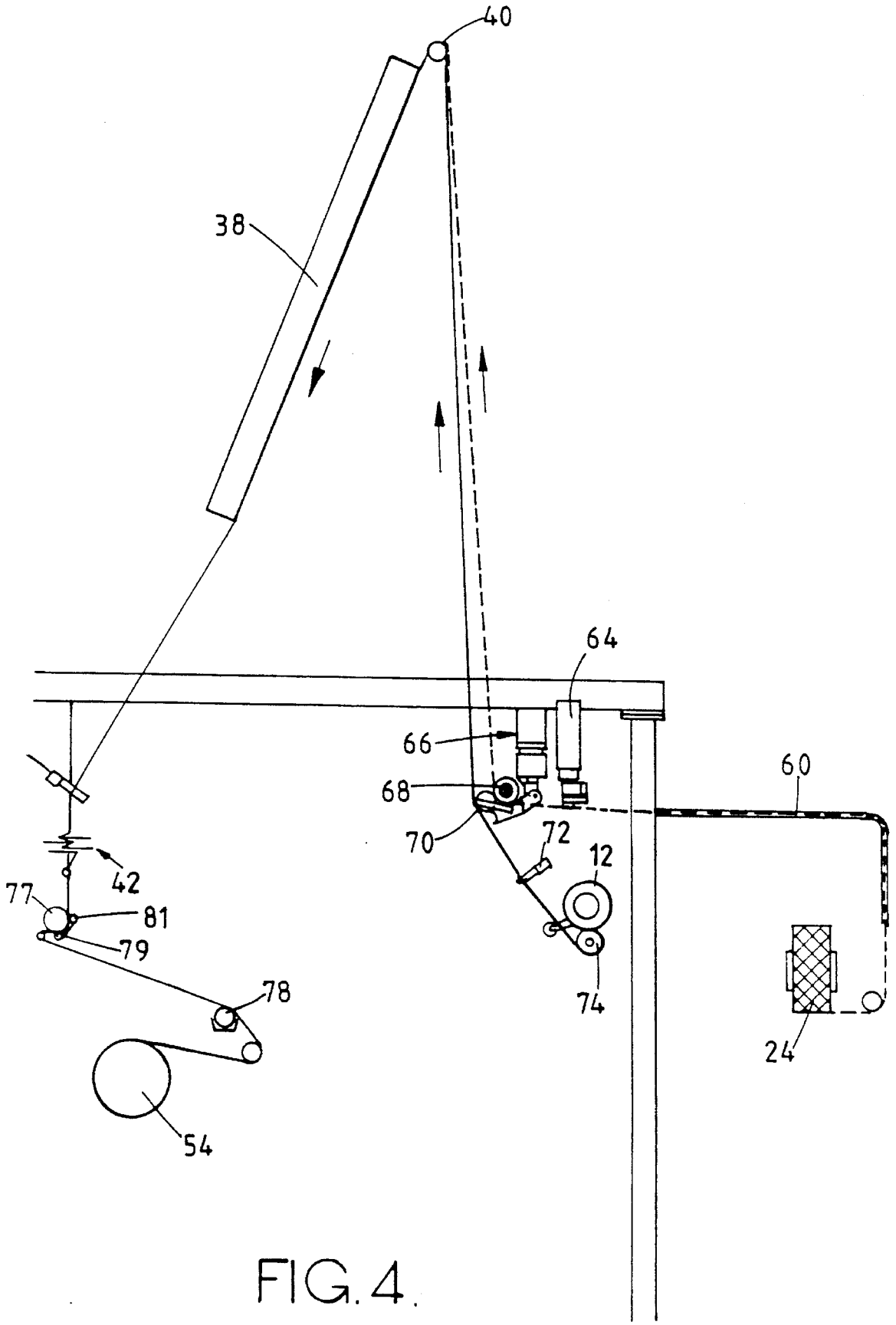
Figure 5:
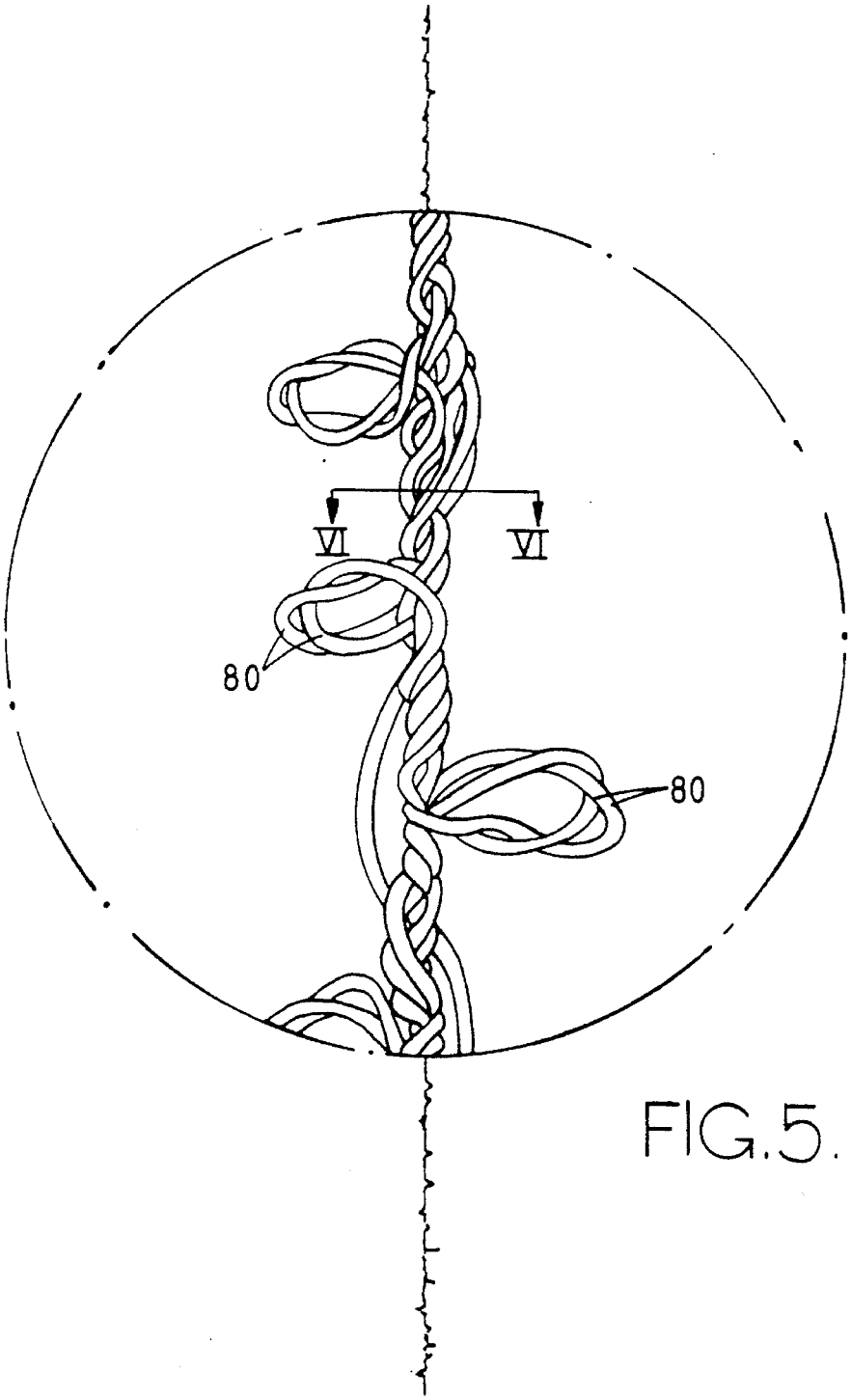
Figure 6:
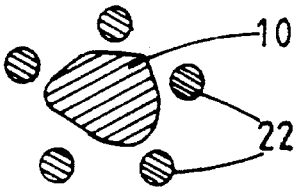

The invention will now be described further by way of example with reference to the accompanying drawings in which:

FIG. 1 illustrates diagrammatically a method of manufacturing a twisted elastic yarn in accordance with a first embodiment of the invention, FIG. 2 illustrates diagrammatically a method similar to that of FIG. 1 for utilizing a partially orientated yarn in accordance with a second embodiment of the invention, FIG. 3 illustrates diagrammatically a third embodiment of the invention starting from partially orientated yarn which is fully drafted prior, FIG. 4 illustrates a practical embodiment of the invention, FIG. 5 illustrates a composite yarn in a relaxed form produced by the method of the invention including an enlarged view of a section of the yarn, and FIG. 6 is a cross-sectional view on the lines VI—VI of FIG. 5.

In FIG. 1 spandex yarn 10, typically Lycra (Registered Trade Mark), is stored on a package 12 which is peripherally driven by a feed roller 14. Lycra (Registered Trade Mark) unwound from the package passes in the direction of the arrows firstly over a frictionless grooved pulley 16 and then, under tension, over a stationary low friction guide 18 into the nip of an overfeed unit located downstream of the guide 18 and, which is generally designated 20.

Fully orientated nylon (or other thermoplastic covering yarn) 22 is unwound from a yarn package 24. The nylon, which is in the form of a flat continuous filament, passes by way of guide eyelets 26, 28 onto the guide 18, where it is slightly spaced from the Lycra, and thence into the nip of the unit 20.

The overfeed unit consists of two free-running rollers 30,32 around which an endless rubber belt 34 known as an "apron" passes. A driven roll 36 is mounted with its axis equally spaced from the axes of the two rollers 30, 32 with the periphery of the roll engaging the periphery of the rollers 30 by way of the belt 34. The roller 32 is not in engagement with the roll 36, the roll being loaded resiliently in contact with the belt hence forming a nip between the roll 36 and the belt 34.

A heater 38 is disposed vertically above the nip of the overfeed unit, an eyelet guide 40 being arranged between the overfeed unit and the heater. The guide 40 enables yarn to be removed from the heater 38 when the machine stops. A friction twister 42 is mounted above the overfeed unit in vertical alignment with the guide 40 and the heater 38. A free-running pulley is shown as 44 for directing the composite yarn towards take-up rollers 46, 48 of which roller 46 is driven and roller 48 is free-running. If desired, the composite yarn may be passed round the roller 48 more than once, typically by use of an advancing reel (not shown.). An essential feature of this embodiment of the invention is that the take-up rollers run at a slower speed than the rollers of the overfeed unit.

In operation, the speed of feed roller 14 is so adjusted relative to that of the take-up rollers 46, 48 that the Lycra (Registered Trade Mark) arrives pre-stretched at the guide 18. With the Lycra (Registered Trade Mark) and nylon yarns lying side-by-side on the guide 18, they are led vertically upwardly through the nip of the overfeed unit 20 and over the surface of the heater 38 and into the friction twister 42 which inserts a twist of 5000 to 6000 turns/meter to form a composite Lycra (Registered Trade Mark) and nylon yarn 50 with the Lycra® and nylon yarns spirally twisted together. The temperature of the heater is thermostatically controlled to prevent fusing of the two yarns. The extent of twist in the composite yarn builds up to an equilibrium of twist in the moving yarn between the overfeed unit and the friction twister. This composite yarn 50 is set in a highly twisted condition as it enters the friction twister which then reverses the twist direction in the emerging composite yarn without substantially untwisting the component yarns. Thus, the emerging composite yarn includes significant lengths of twisted Lycra® and nylon yarns set in their original highly twisted condition.

The composite yarn 50 then passes over the pulley 44 pulled by the rollers 46, 48 and thence over guide 51 and a lubricating roller 52 to be taken up on a final package 54 which is peripherally driven by a take-up roller 56.

Since the constituent yarns are not fused together, each yarn is free to extend and contract freely one relative to the other when relaxing whilst retaining sufficient cohesion by virtue of original twist to prevent their separation.

In FIG. 2, similar reference numerals have been used to designate similar parts to those of FIG. 1.

This embodiment is used to combine partially orientated yarn such as nylon or polyester yarn with the spandex core yarn such as Lycra (Registered Trade Mark). The drawing or drafting of the nylon occurs between the unit 20 and the take-up rollers 46, 48. However, the unit 20 is not run as an overfeed unit but rather at a substantially slower speed than the roller 46, the level of draft being adjusted to requirements and shrinkage allowed for in the heated zone. Hence, instead of the nylon being overfed to the rollers 46, 48 to accommodate twist and shrinkage, in the second embodiment twist and shrinkage are accommodated by the continual extension of the partially drawn nylon.

If desired, the Lycra yarn can be fed direct to the heating zone without first passing through the unit 20.

As in the first embodiment the spandex yarn and nylon yarn are not fused together thus leaving each yarn to extend and contract freely and independently.

The apparatus illustrated in FIG. 3 is similar to that shown in FIGS. 1 and 2 and, where appropriate, similar reference numerals have been used to designate the same parts. In this embodiment however, complete drafting of the partially orientated yarn is provided for between an additional pair of drafting rollers 58, 60 located between the yarn package and the nip of the belt feed unit 20. The fully drawn nylon is then overfed by the overfeed unit 20 to the take-up 46, 48 in the manner described in the first embodiment of the invention.

Yarn processed by the methods described meet the requirements of a composite yarn with sufficient cohesion to allow knitting or weaving without yarn separation, and control of the extension of the spandex yarn by the rigid nylon or other yarn. The secondary requirement of protection of the spandex yarn are automatically provided.

The mechanism ensuring the required cohesion has four components:

1) entanglement of the nylon filaments through texturing and shrinkage, 2) sections of real twist produced by the two yarns untwisting i.e. reverse twist, as a single unit, 3) residual torque in both yarns induced by heating when in a twisted condition which resists separation, and 4) a low level of real twist alternating S and Z.

Some further description will now be given in relation to the overfeed unit, the temperature requirements and the twister.

(i) Overfeed

The overfeed unit, when used, performs two functions. Both yarns pass through the unit thus simultaneously allowing overfeed of nylon to compensate for twist and shrinkage, and at the same time, bringing the two yarns together. The unit thus acts on both components simultaneously but while the nylon is free and the amount taken up governed by the speed of the overfeed roller, the feed of spandex yarn is limited by the feed roller 14. The unit thus increases the draft up to the overfeed roll 36 but this reverts to the mean draft subsequent to overfeed roll 36.

The overfeed unit is important when fully drawn nylon is being overfed as it is in the area covered by the belt contact with the overfeed roller that the two yarns are brought together. As the nylon has not shrunk at this stage, the extra length has to be distributed very evenly over the spandex yarn. It is thought some initial twisting starts in this area. The placing of the two yarns is important also as it affects the even distribution of the nylon.

(ii) Temperature

The heat applied by the heater plate 38 sets the two component yarns in spiral form and shrinks and texturizes the nylon around it. Unfortunately, the heat tolerances of both yarns are dissimilar. Normal texturing temperature for nylon 6.6 is around 200° to 220° C. but above 155° to 165° C. Lycra is so softened as to allow the shrinking nylon to cut into the filaments. This produces the fault known as "core chopping".

In contrast, in the present invention, the yarns are heated to a temperature with the range 140° to 160° C., i.e. significantly below that used hitherto and in any event below the temperature at which nylon is normally texturized.

(iii) Twist

Temporary twist (known as false twist) is achieved by feeding two yarns against rotating discs which is known as friction twisting. Friction twisting imposes very low stress on the yarns. In this way a twist of 5000 to 6000 turns per meter is applied.

When using fully drawn thermoplastic yarn which is to be overfed to accommodate shrinkage, the level of twist controls the take-up of the overfed nylon. If the twist is inadequate the level of cohesion is reduced whereas if it is excessive, the shrinking nylon will cut into the spandex lowering the threshold of core chopping.

It will be appreciated that in each embodiment of the invention, both yarns are thermoplastic and it is this property which locks them together in a spiral configuration. Hence, when subjected to an opposing twist at the exit from the friction twister, the yarns behave substantially as a single thread with a high level of torque in the direction of the original twist. In addition to "locking" the two yarns together in spiral configuration, self-twisting forces are generated by the torque in both yarns at the exit from the twisting unit which torque reinforces the cohesion of the two yarns into a composite yarn.

In practical terms, inadequate cohesion between the yarns allows individual nylon filaments to trap other yarn layers as the yarn is withdrawn from its package, raising the mean yarn tension thus creating excessive peaks which contribute to yarn breakage. On the other hand, excessive cohesion encourages the nylon to "embed" in the spandex which causes incipient cutting of the spandex which then breaks under the stress of knitting.

In the practical embodiment of FIG. 4, where appropriate, similar reference numerals have been used to those of the earlier embodiments.

Pre-stretched spandex yarn from the package 12 is fed at a first speed, typically 125 meters per minute, to a guide 40 but by way of a yarn breakage detector 72. The guide 40 is normally a "twist-stop-pulley" and so acts both as a guide for bringing the spandex and nylon yarns together and at the same time prevents migration of twist imparted to the yarns in an upstream direction. The detector 72 is connected electrically to a movable feed roller 74 of the yarn package 12 so that should the detector 72 detect breakage of the spandex, the movable feed roller 74 is moved out of driving action so ceasing further spandex feeding.

Incompletely drawn nylon yarn from the yarn package 24 is fed at a second speed, typically 385 meters per minute, through a tubular guide 60 ultimately to the guide 40. During its passage to the guide 40, the yarn passes a yarn cutter 64 and a driving unit 66. The cutter 64 is connected to the detector 72 and enables for example the yarn to be cut when a breakage in the spandex feed is detected by the detector 72. Similarly, a detector (not shown) associated with the cutter 64 cuts the supply of nylon yarn in the event of yarn breakage. This detector is also connected to a cutter associated with the detector 72 so that the spandex yarn supply also is cut when a break in the nylon feed occurs.

The driving unit includes two rollers the lower one of which 68 is driven and acts as a drafting roller. The other roller 70 is free running but in friction contact with the driving roller. As distinct from the embodiments of the invention shown in FIGS. 1 to 3, in this embodiment the drafting roller is located upstream of the guide position.

From the guide 40, the nylon and spandex are fed diagonally downwardly across a surface of the heater 38 where they are simultaneously heated and twisted as previously described.

Downstream of the twisting head 42, the composite yarn is fed into a nip. The nip is provided by an "apron" feeder similar to the unit 20 described with respect to the earlier embodiments. In FIG. 4 however the driven roll is designated 77 and the two rollers as 79, 81. The roll 77 drives the yarn into the nip at a third speed, typically 500 meters per minute. This third speed is greater than either the first speed at which the spandex yarn is driven or the second speed at which the partially orientated nylon is driven. In this way the incompletely drawn nylon is drafted, more especially under the action of heat, between the drafting roller 68 and the nip.

It will be appreciated that the nip is not necessarily provided by an "apron" feeder since it could equally be provided between a pair of co-operating rollers. An additional guide 76 downstream of the heater leads the then twisted composite yarn to a twisting head shown generally at 42. Finally, the composite yarn passes round an oil roller 78 and then onto the final package 54.

The conditions described in the erstwhile embodiments apply equally in this embodiment of the invention. Thus the heater temperature is important, the preferred temperature being 150° C. so that the yarns are not melted and are free in the final composite product to move one relative to the other.

Referring now to FIG. 5, as may be seen from the enlarged section, the composite yarn includes loops of nylon yarn 80 which project laterally in spaced apart positions where for example the imparted twist has not been fully retained. The cross-sectional view of FIG. 6 shows that no fusing occurs between the spandex yarn 10 and the nylon yarn 22, thus enabling the free and independent movement of the two yarns to which reference has already been made.

EXAMPLES

Yarns described in the following examples were tested for withdrawal tension at 1000 m per minute on a Scragg Package Performance Analyser and knitted on a single feed 3¾ inch (9.5 cm) 408 needle single feed knitting machine.

EXAMPLE 1

Spandex Yarn: 22 decitex Lycra (Registered Trade Mark)

Nylon yarn: 20/5 decitex P.O.Y Polyamide Type 66

P.O.Y draw ratio: 1.300

Elastane draw ratio: 4.000

*D/Y ratio: 1.8

Heater temperature: 150° C.

Spandex yarn speed at movable feed roller 74: 125 metres per minute

Nylon yarn speed at roller 68: 385 meters per minute

Composite yarn speed at roll 77: 500 meters per minute

Performance analysis: machine running speed; 1000 m/minute
mean yarn tension; 2 grams
peak yarn tension; 11 grams After knitting combined yarn produced under the above conditions for a period of 10 minutes, no knitting faults were obtained.

EXAMPLE 2

Spandex yarn: 22 decitex elastane fibre

Nylon yarn: 16/5 decitex P.O.Y Polyamide Type 66

P.O.Y. draw ratio: 1.301

Elastane draw ratio: 4.36

*D/Y ratio: 1.8

Heater temperature: 150° C.

Spandex yarn speed at movable feed roller 74: 115 metres per minute

Nylon yarn speed at roller 68: 384 metres per minute

Composite yarn speed at roll 77: 500 metres per minute

Performance analysis machine running speed; 1000 m/minute mean yarn tension; 2 grams peak yarn tension; 8 grams No knitting faults were detected in a fabric knitted from composite yarn produced under the above conditions.

$$*D/Y \text{ ratio} = \frac{\text{surface speed of friction disc}}{\text{production speed of yarn}}$$

It has been found the three feed speeds given in the examples can be varied by plus or minus 10% . Further, in experimental work, the process has been run successfully at composite yarn speed of 750 meters per minute with corresponding increases in the first and second yarn feed speeds.

I claim:

1. A method of manufacturing a combined yarn which comprises feeding a spandex yarn to a guide position with a driven feed at a speed arranged to provide a pre-stretched condition in said spandex yarn, feeding a polyamide or polyester yarn separately from the spandex yarn to the guide position to lie adjacent the spandex yarn, feeding both yarns from the guide position to a false twister by way of a heater, heating both yarns at the heater to a temperature sufficient to soften but not melt them, whilst simultaneously subjecting the yarns to spiral twist, permitting the heated and spirally twisted composite yarn to set without fusing to retain imparted twist, a reverse twist being imparted to the set composite yarn at the exit from the false twister, said reverse twist providing an overall torque to the composite yarn in the same direction as that of the spirally-set twist so that the composite yarn has its component yarns locked together in spiral configuration, the pre-stretched spandex yarn being fed at a first speed to the guide position, the polyamide or polyester yarn being incompletely drawn and fed separately at a second speed to the guide position, and feeding the twisted and set composite yarn to a nip position at a third speed, the third speed being greater than both said first speed and said second speed so that the incompletely drawn polyamide or polyester yarn is drafted between a drafting device running at said second speed and the nip position.

2. A method as claimed in claim 1, in which the drafting device is located either upstream or downstream of the guide position.

3. A method as claimed in claim 1, in which the yarns are heated to a temperature lying within the range of 140° C. to 160° C.

4. A method as claimed in claim 1, in which the yarns are fed diagonally downwardly across a heated surface and down into the false twister.

5. A method as claimed in claim 1, 2, 3 or 4, in which the first speed is 125 metres per minute, the second speed is 385 metres per minute and the third speed is 500 metres per minute, all speeds plus or minus 10%.

6. A method as claimed in claim 1, in which the spandex yarn is fed through the guide position to the drafting device with the incompletely drawn polyamide or polyester yarn.

7. A method as claimed in claim 1, in which the yarns are fed vertically upwardly across a heated surface and into the twisting section.

8. A method as set out in claim 1, wherein the steps of heating, twisting and drafting all occur simultaneously.

* * * * *